US005634981A

United States Patent [19]

Mueller et al.

[11] Patent Number: 5,634,981

[45] Date of Patent: Jun. 3, 1997

[54] METHOD AND APPARATUS FOR CLEANING THE DENTS OF A WEAVING REED

[75] Inventors: Herbert Mueller, Kressbronn; Adnan Wahhoud, Bodolz; Leonhard Groeger, Nordwalde, all of Germany

[73] Assignee: Lindauer Dornier Gesellschaft mbH, Lindau, Germany

[21] Appl. No.: 386,809

[22] Filed: Feb. 8, 1995

[30] Foreign Application Priority Data

Feb. 8, 1994 [DE] Germany ..... 44 03 888.7

[51] Int. Cl.[6] ..... B08B 7/04

[52] U.S. Cl. ..... 134/5; 134/19; 134/37; 139/1 C; 139/192

[58] Field of Search ..... 134/5, 19, 21, 134/37; 139/1 C, 192

[56] References Cited

U.S. PATENT DOCUMENTS 4,964,441 10/1990 Long et al. ..... 139/1 C
5,074,338 12/1991 Weber ..... 139/1 C
5,237,717 8/1993 Watson ..... 15/302
5,244,504 9/1993 Watson ..... 134/21

FOREIGN PATENT DOCUMENTS 0128256 12/1984 European Pat. Off. .
0413444 2/1991 European Pat. Off. .
2615483 10/1977 Germany .

*Primary Examiner*—Jill Warden
*Assistant Examiner*—Saeed Chaudhry
*Attorney, Agent, or Firm*—W. G. Fasse; W. F. Fasse

[57] ABSTRACT

Avivage deposits on and between the dents of a reed, especially in an air weaving loom, are removed by heating at least a portion of the reed dents in the vicinity of the weft insertion channel to a temperature sufficient to melt the avivage which can then be discharged from the reed dents and the spaces between the reed dents by dripping downwardly, for example, into a collecting trough.

10 Claims, 3 Drawing Sheets

METHOD AND APPARATUS FOR CLEANING THE DENTS OF A WEAVING REED

FIELD OF THE INVENTION

The invention relates to a method and apparatus for cleaning the dents or lamellae of a weaving reed, especially in an air nozzle loom in which weft threads are used that have been treated with an avivage coating containing a fatty or waxy lubricant.

BACKGROUND INFORMATION

It is known to treat threads or yarns of synthetic fibers with a lubricant that contains substances fatty or waxy substance in order to improve the handling ability and to maintain the softness and suppleness of the fabrics that are woven of such synthetic fibers. The resulting coating on the yarns or threads is referred to as an avivage coating.

When such threads or yarns are used as weft threads for producing of special fabrics on air nozzle looms, it has been found that the air insertion impulses emanating from the insertion nozzles for carrying the weft thread through the weft thread insertion channel in the reed, removes avivage particles from the surface of the weft thread. These particles have a tendency to attach themselves to the reed dents and to even enter into the spacings between neighboring reed dents.

As a result of such transfer of the lubricant from the weft threads onto and into the reed, the reed dents themselves have an avivage coating after a certain operational time of the loom has passed. This fact is undesirable because it negatively influences the aerodynamic characteristics of the reed, especially in the area where the reed dents form the weft insertion channel, thereby in turn negatively influencing the transport characteristics of the weft insertion in the air insertion channel.

It has further been found in practice that the avivage coating on the reed dents becomes tacky, whereby the warp threads may be damaged, and whereby the proper weft insertion is hindered.

German Patent Publication DE-OS 2,615,483 (Schreus) discloses an apparatus for cleaning weaving reeds by using a tool with a plurality of knife blades that are inserted into the spaces between neighboring reed dents. The tool cooperates with a solvent dispensed through a pipe. The dispensed solvent that has taken up avivage, is collected in a trough positioned below the reed. The inserted knife blades are moved along the entire effective length of the reed dents, or rather along the reed pass. The quantity of the solvent or cleaning liquid used will depend on the extent of the soiling of the reed dents. The just described reed cleaner has the disadvantage that the cleaning knives must be precisely inserted into the very narrow gaps between neighboring reed dents without damaging the reed dents in order to assure a proper mechanical removal of the avivage. Damage to the reed dents must be avoided because damaged reed dents interfere with a proper guiding of the warp threads and may even damage the warp threads.

It is further known from European Patent Publication EP 0,128,256 A1 (Kaegi) to use a cleaning brush for removing avivage or other contaminations such as lint, etc. from the reed dents. The cleaning brush is mounted on a carriage which in turn can travel along tracks or guides alongside the reed. The brushes are rotating while the carriage travels along the reed. The cleaning apparatus must be adapted to the particular type of loom so that the proper travel along the loom reed is possible.

European Patent Publication EP 0,413,444 A1 (Long et al.) based on U.S. Ser. No. 393,892, filed in the USA on Aug. 15, 1989 (U.S. Pat. No. 4,964,441) discloses an apparatus with a cleaning head that blows a cleaning foam onto the reed teeth and through the spaces between the reed teeth. The foam or foaming agent dislodges lint, dust and the like, and the dislodged dirt carried by the foam is sucked back through the spaces between the dents and directed so as to be collected in a container that travels along the reed together with the cleaning head. A removal of the reed from the loom is not necessary. Similarly, the warp threads do not have to be removed from the reed.

U.S. Pat. No. 5,244,504 (Watson) discloses a loom reed cleaning method and apparatus in which high pressure air blows lint, dust and so forth away from the reed, whereby again the cleaning mechanism travels along the reed on wheels including lateral guide wheels. The apparatus includes a suction channel on the back side of the reed to take up any dislodged reed soiling elements.

All the above described devices and methods of the prior art aim at cleaning the reed teeth after a weaving sequence has been completed in order to remove the contaminations that have been accumulated during the weaving sequence. As a result, the weaving of the loom must be stopped for the cleaning operation, which is dead time as far as the actual weaving of fabric is concerned. All known devices cannot be used during actual weaving. Further, the known methods and devices are not suitable for use in air nozzle looms which use weft threads that have been treated with so-called avivage to form the above mentioned surface coatings. In addition to the above reasons for the treatment of the weft threads with an avivage coating, it was also intended to minimize the contamination of the reed, e.g. by reducing the formation of lint. However, it has been found that the avivage itself contaminates the reed teeth and the prior art has no Solution for this problem.

OBJECTS OF THE INVENTION

In view at least one of the above it is the aim of the invention to achieve the following objects singly or in combination:

to provide a method and apparatus for efficiently cleaning reed teeth, especially in an air nozzle loom in which the reed teeth are being soiled by avivage particles;

to avoid the deposition and solidification of avivage on the surfaces of the reed teeth and in the gaps between the reed teeth; and to provide a reed teeth cleaning method and apparatus that can be effective during the weaving either continuously or intermittently and that can be controlled easily.

SUMMARY OF THE INVENTION

The above objects have been achieved by the method according to the invention which is characterized in that the reed or at least the reed dents or teeth or portions of the reed dents or teeth are heated to a cleaning temperature, whereby the heating may begin even before starting the weaving operation of the loom and/or may be continued during the weaving either continuously or during timed intervals. Preferably, the heating temperature is such that avivage will either melt or not solidify in the first place. This feature has the advantage that the liquid avivage and any dirt particles enclosed by the liquid or melted avivage can be easily discharged from the reed. In its simplest form the discharge of the liquid avivage takes advantage of gravity whereby the droplets fall downwardly into a collecting trough.

Depending on the type at least one of avivage the heating of the reed and/or at least one of the individual reed dents can be so controlled that the supply of heat is efficiently adapted to provide the heat quantity necessary for melting the avivage and assuring its removal from the reed in liquid form including any dirt carried away by the liquid avivage. In its preferred form the heat quantity will be so controlled that a formation of a solid avivage layer on the reed dents is avoided. The reed dents should be heated to a temperature within the range of about 30° C. to about 40° C. which has been found to be sufficient to remove avivage.

The apparatus according to the invention comprises a heater that is so positioned that the dents of the reed are heatable from a source of energy that is controlled so as to control the temperature of the dents. The energy source is preferably an electrical energy source and the heater is preferably an electrical resistance heating element or elements. A resistance element can be integrated directly into at least one, preferably into each reed dent so that each reed dent itself forms at least one electrical resistance heating element that simultaneously functions as a reed dent.

In another preferred embodiment the source of heat may be the gear oil of the loom. The warm gear oil is pumped through a heat exchanger in a closed circulating circuit, the pump of which is controlled in response to the temperature of the reed dents by a sensor positioned to sense the temperature of the reed dents, preferably at an upper end of the dents. A temperature sensor or thermostat is also used to control the operation or the energizing of the electrical heater element or elements.

The electrical resistance heating may use air or liquid as a heat carrier. Heat conducting flat plates may be heated by the electrical resistor or by a heat exchanger through which the warm gear oil circulates. The flat heat conducting plates are positioned to reach into the spaces between neighboring reed dents.

It is an important advantage of the invention that the cleaning of the reed dents can be performed while the loom is weaving because the dents can be heated during the weaving operation, whereby down times are minimized since the loom does not need to be stopped for a cleaning operation except for the removal of collected avivage, for example in a trough into which melted avivage drips.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
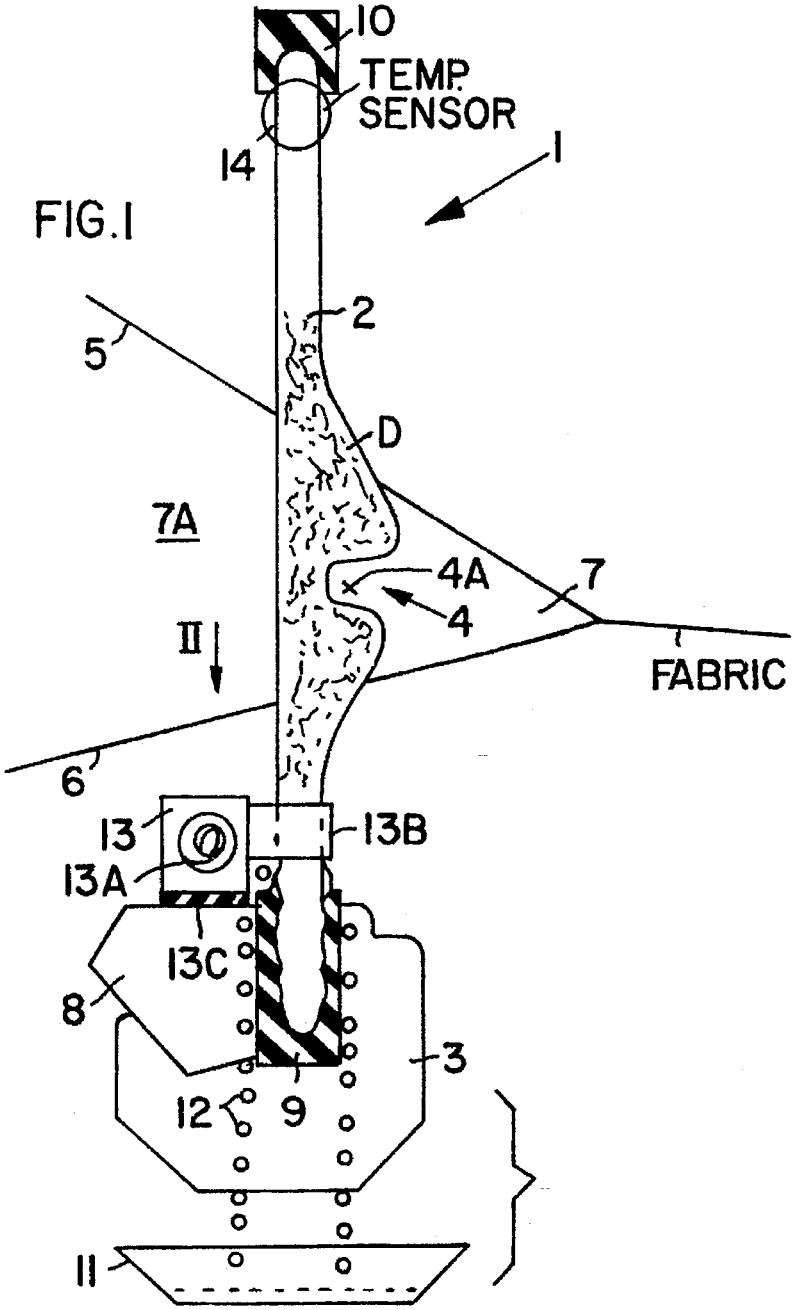
FIG. 1 is a schematic side view of a reed with its sley equipped with an electrical dent heater according to the invention.
Figure 4:
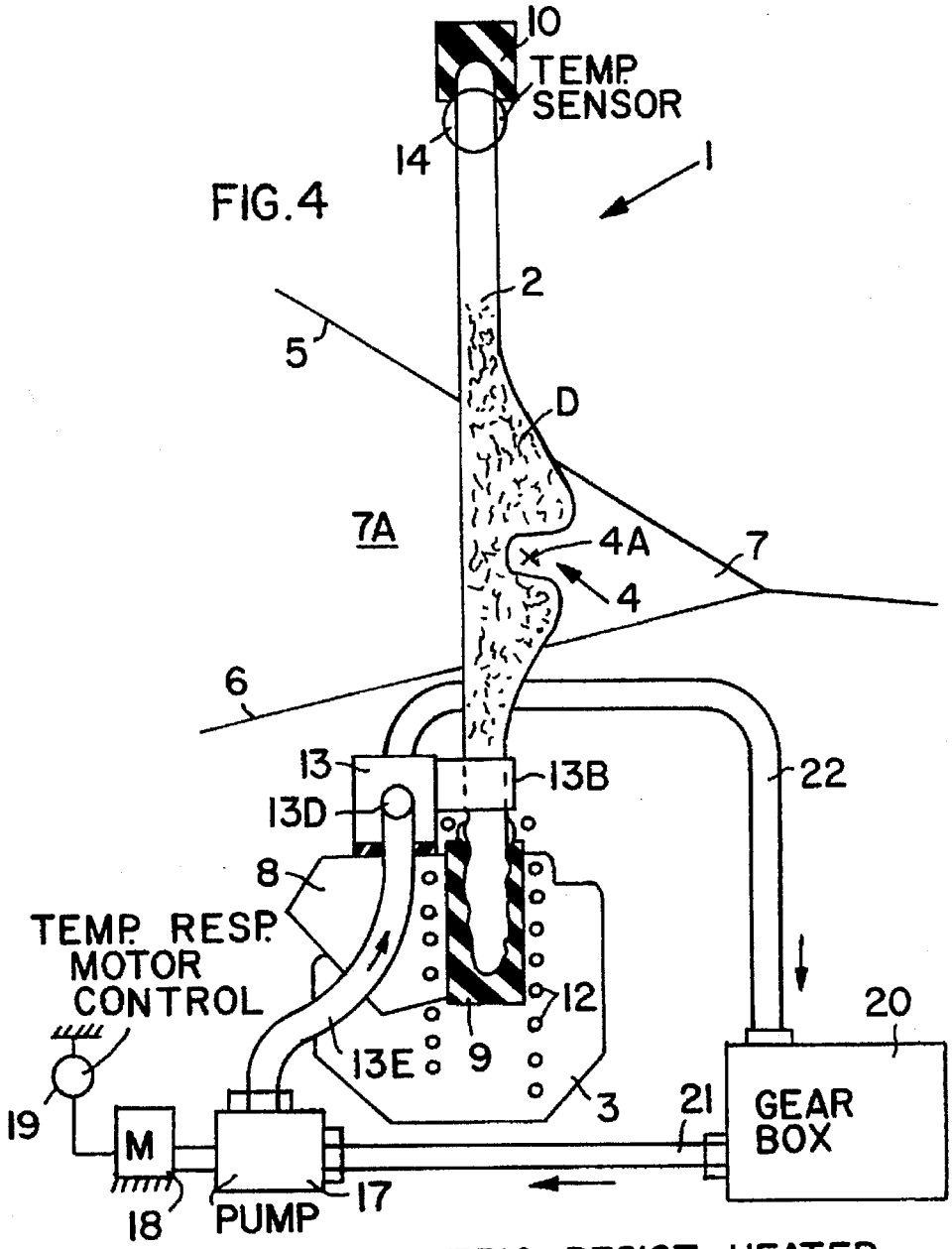
FIG. 4 is a view similar to that of FIG. 1, but showing a modified embodiment in which gear oil in a gear box of the loom is used as a heat source for heating the reed dents.
Figure 5:
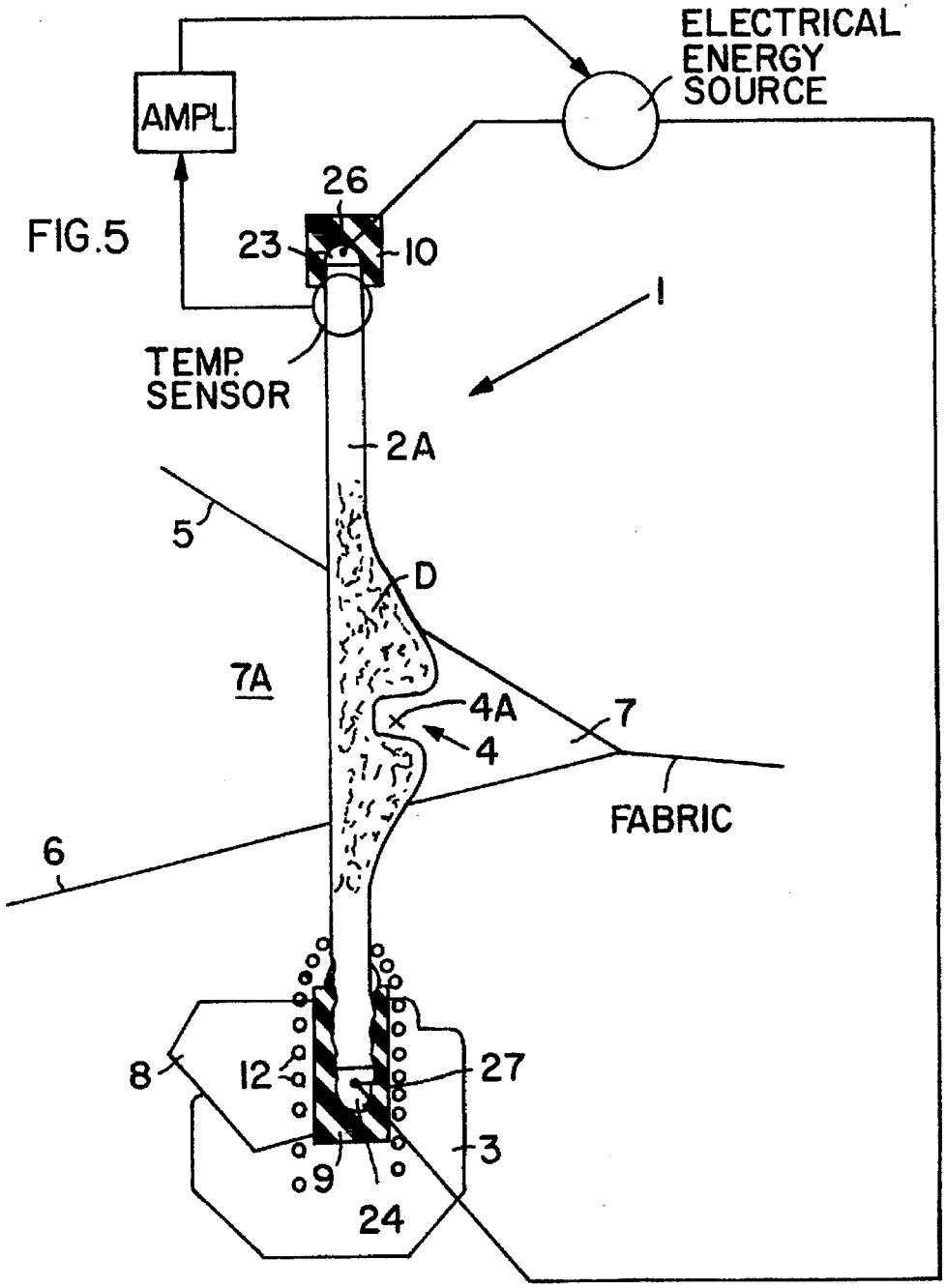
FIG. 5 shows a section through a reed sley similar to that of FIG. 1, wherein each reed dent forms itself an electrical resistance heating element.

Referring to FIGS. 1, 4 and 5, the features common to all embodiments will first be described. FIGS. 1, 4 and 5 show a side view of a reed 1 having reed teeth 2 or 2A mounted in a loom sley 3. The reed teeth 2, 2A form a weft insertion channel 4 with a weft thread 4A extending perpendicularly to the plane of the drawing as the weft thread 4A travels through the channel 4 propelled by air jets not shown. An upper warp thread 5 and a lower warp thread 6 form a loom shed 7 having a back portion 7A behind the reed 1. A clamping bar 8 holds the lower end of the reed teeth in place in the sley 3 with a form locking or location fit. Preferably, the lower ends of the reed teeth 2, 2A are received in a thermally and electrically insulating mounting member 9 which is held in place in the sley 3 by the clamping bar 8. It is preferable that the upper end of the reed teeth 2, 2A are also mounted in a thermal and electrical insulator such as an insulator bar 10 which in turn is held in the upper frame member of the reed 1. The upper frame member itself is not shown in the drawings. A stippling D shown near the weft insertion channel 4 on the reed dents 2, 2A illustrates the accumulation of avivage including dirt enclosed in the avivage on and between the dents particularly in the vicinity of the insertion channel 4. The dirty avivage D tends to accumulate above and below the insertion channel 4 primarily within the shed 7 but also above and below the shed.

FIG. 1 shows a trough 11 for collecting droplets 12 of melted avivage. Such a trough is also used in the other embodiments.

Figure 2:
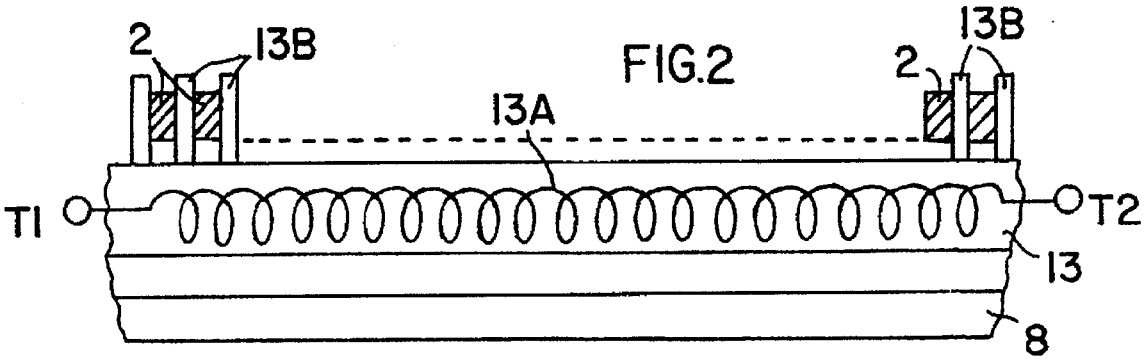
FIG. 2 is a view partly in section in the direction of the arrow II in FIG. 1, showing electrically heated heat conductor flat plates intermeshing with the reed dents.

According to the invention the melting of the avivage D accomplished in FIGS. 1 and 2 by an electrical heater block 13 equipped with an electrical heater coil 13A and heat conducting flat plates 13B which intermesh with the reed dents 2 as best seen in FIG. 2. The heater block 13 is preferably mounted through a heat insulator 13C on the clamping bar 8 which in turn is secured in a form-locking manner to the sley 3, thereby holding the mounting member 9 and the heater block 13 in place. The heater block 13 extends over the entire width of the reed 1 in the weft insertion direction and below the backside 7A of the loom shed 7. Viewed vertically, the heater block 13 is positioned between the mounting member 9 and the insertion channel 4. As shown in FIGS. 1 and 2, the flat heat conductor plates 13B are in a surface area heat transfer contact with the reed dents 2 for heating each dent 2 individually or for heating every second or every third dent and so forth. Instead of heating the heater block 13 with an electrical resistance coil 13A, another heat source may be used, for example heated air or a heated liquid may pass through the block 13 as will be described below in more detail with reference to FIG. 4.

Figure 3:
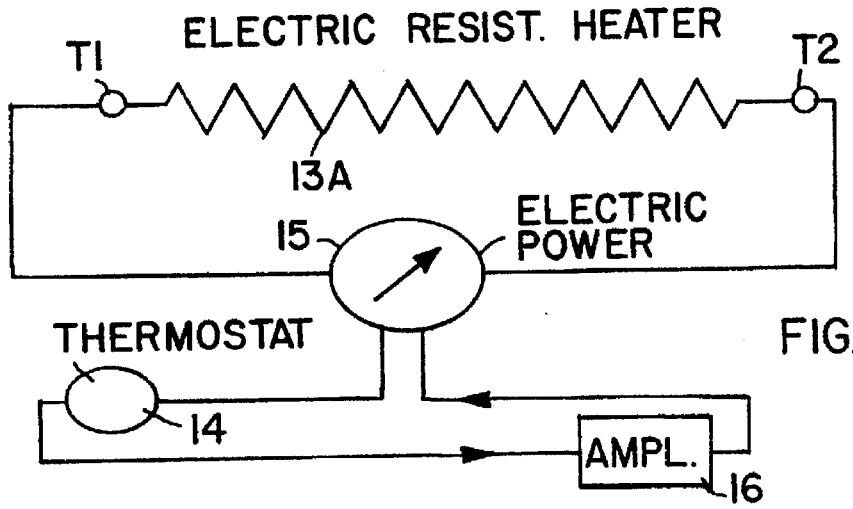
FIG. 3 shows an electrical control circuit for controlling the temperature of the reed dents by controlling the electrical power supply source that energizes an electrical resistance heater or heaters.

Referring to FIG. 3, the electrical resistance heater coil 13A is connected to an electrical power source 15 that in turn controlled, for example through a temperature sensor or thermostat 14 preferably positioned as shown in FIGS. 1, 4 and 5 at the upper end of the dents 2, 2A. The signal ream the sensor 14 is preferably amplified in an amplifier 16 for switching the power source 15 on and off in timed intervals to maintain the temperature of the dents 2, 2A within a suitable range, for example 30° C. to 40° C. sufficient for melting the avivage so that melted avivage droplets 12 and any dirt enclosed by these droplets 12 discharged from the reed dents 2, 2A can be collected in the trough 11 as shown in FIG. 1. The amplifier 16 may include a suitable timing device of conventional construction. Although the operation of the power supply in timed intervals is preferred because it saves energy, it is also possible to continuously heat the dents to the required temperature that will depend on the type of avivage with which the weft threads 4A have been treated.

FIG. 4 shows an embodiment in which the heater block 13 is a heat exchanger coupled through a coupling 13D and through a flexible hose 13E to a pump 17 driven by a motor 18 controlled by a temperature responsive control circuit 19, which in turn is responsive to the temperature sensor 14. A pipe 21 connects the pump 17 to a gear box 20 of the loom. A flexible return hose 22 connects the heater block 13 of the heat exchanger back to the gear box 20. The hoses 13E and 22 are sufficiently flexible to permit the beat-up movement of the sley 3. The pipe 21 and the flexible hoses 13E and 22 form with the pump 17, with the block 13, and with the gear box 20 a closed fluid flow circuit in which the gear oil is circulated flows as indicated by the arrows. The motor 18 may be operated continuously or intermittently under the control of the motor control 19 and in response to the sensed temperature of the reed dents 2. The heated flat plates 13B of FIG. 4 function in the same way as the respective plates in FIG. 1 for keeping the dents 2 at the desired temperature.

Figure 6:
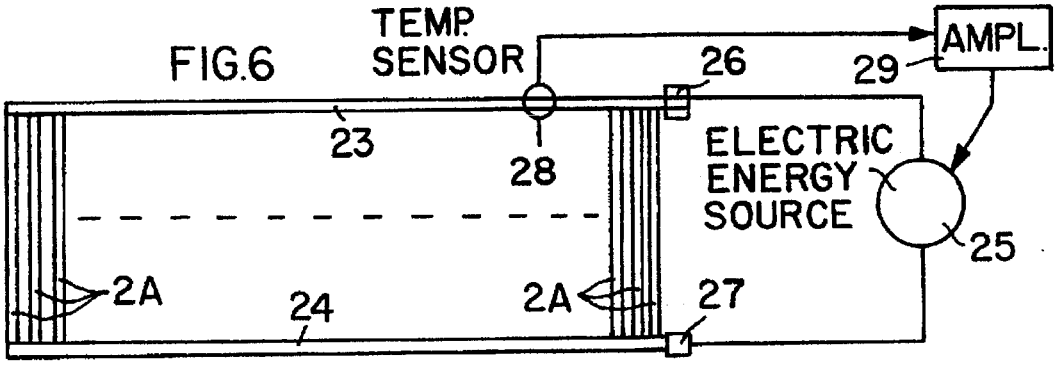
FIG. 6 shows an electrical heating circuit, wherein the reed dents of FIG. 5 are electrically connected in parallel and to an electric energy source.

FIGS. 5 and 6 show an embodiment in which each reed dent 2A itself or at least a portion thereof is constructed as an electrical resistance heater element which is connected electrically in parallel to all the other respectively constructed dents 2A as shown in FIG. 6. Two electrical conductor bars 23 and 24 connect the dents 2A to a source of electrical energy 25 through terminals 26 and 27. The energy source 25 is controlled in response to a signal provided by a temperature sensor 28 supplied through an amplifier 29 that may include a conventional timer. The individual dents 2A or at least a portion of each dent in the vicinity of the channel 4 may be made of any suitable electrical heater resistor material such as CrNi- or NiCr-resistance alloys. It is sufficient to make only a dent portion that gets soiled an electrical resistance element. For example, the portion of the dents 2A that is stippled at D may be constructed as electrical resistance heater elements while the remainder of each dent would be made of a suitable electrically conducting material.

Air looms equipped with a reed according to the invention are especially suitable for weaving fabrics for air bags. The weft threads for such fabrics are treated prior to weaving with a fatty substance. Due to the high speed at which the weft thread 4A is passed through the insertion channel 4 of the air nozzle loom by the air transport jets, so-called avivage particles are separated from the travelling weft thread and deposited on the reed dents and between the reed dents. This deposit is especially taking place in the vicinity of the insertion channel as indicated by the stippling D. It has been found that the just mentioned vicinity around the insertion channel 4 has a temperature that is low enough to cause the solidification of the avivage presumably due to the temperature of the weft thread transporting air jets. By heating the reed teeth at least in the vicinity of the insertion channel, the invention has advantageously removed the problem. As mentioned above, a suitable temperature is within the range of about 30° C. to about 40° C. However, this temperature may vary depending on the type of avivage. By heating the entire length or width of the reed at least in the vicinity of the insertion channel, the reed remains clean and functional and expensive down times have been avoided or at least substantially reduced.

Although the invention has been described with reference to specific example embodiments, it will be appreciated that it is intended to cover all modifications and equivalents within the scope of the appended claims.

What is claimed is:

1. A method for cleaning dents of a reed in a weaving loom, comprising the following steps:

(a) raising a temperature of said reed dents sufficiently for melting avivage from said feed dents, (b) discharging melted avivage and any dirt enclosed in said melted avivage away from said dents, and (c) collecting melted avivage and any dirt enclosed in said melted avivage.

2. The method of claim 1, wherein said temperature raising step comprises preheating said dents prior to starting a weaving operation.

3. The method of claim 1, wherein said temperature raising step is performed during a weaving operation.

4. The method of claim 3, wherein said temperature raising step is performed intermittently during respective time intervals.

5. The method of claim 1, wherein said temperature range is within 30° to 40° C. sufficient for said melting.

6. The method of claim 1, further comprising measuring said temperature of said dents and controlling an energy source in response to said measured temperature.

7. The method of claim 1, wherein said step of raising the temperature of said reed dents comprises supplying electrical energy to at least one of said reed dents.

8. The method of claim 1, wherein said step of raising the temperature of said reed dents comprises feeding weft threads through a weft insertion channel in said reed by heated air forming weft transport jets.

9. The method of claim 1, wherein said step of raising the temperature of said reed dents comprises feeding a heated fluid through a channel in heat transfer contact with at least one reed dent.

10. The method of claim 1, wherein said step of raising the temperature of said reed dents comprises passing electrical energy through at least one electrical resistance heating element positioned for applying heat to at least one of said reed dents.

* * * * *